US010351287B2

(12) United States Patent
Eberbach

(10) Patent No.: US 10,351,287 B2
(45) Date of Patent: Jul. 16, 2019

(54) METHOD FOR USING A PACKAGE INSERT FOR CUSHIONING AN OBJECT

(71) Applicant: INTERNATIONAL BUSINESS MACHINES CORPORATION, Armonk, NY (US)

(72) Inventor: Adam H. Eberbach, Surrey Hills (AU)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 420 days.

(21) Appl. No.: 15/194,709

(22) Filed: Jun. 28, 2016

(65) Prior Publication Data

US 2017/0369225 A1 Dec. 28, 2017

(51) Int. Cl.

| | |
|---|---|
| ***B65B 55/20*** | (2006.01) |
| ***B65B 5/04*** | (2006.01) |
| ***B65B 61/22*** | (2006.01) |
| ***B65B 67/02*** | (2006.01) |
| ***B65D 81/05*** | (2006.01) |

(52) U.S. Cl.

CPC ..... *B65B 61/22* (2013.01); *B65B 5/04* (2013.01); *B65B 55/20* (2013.01); *B65B 67/02* (2013.01); *B65D 81/05* (2013.01); *B65B 2210/04* (2013.01)

(58) Field of Classification Search

CPC ..... B65B 55/20; B65B 61/20; B65B 61/22; B65D 81/05

USPC ..... 53/474, 445, 472, 139.5, 238; 206/521

See application file for complete search history.

(56) References Cited

U.S. PATENT DOCUMENTS

| | | | | | |
|---|---|---|---|---|---|
| 3,222,843 | A | * | 12/1965 | Schneider | B65D 81/113 206/524 |
| 4,136,141 | A | * | 1/1979 | Bauer | B65B 55/20 206/524 |
| 4,608,893 | A | * | 9/1986 | Huhne | B26D 1/553 83/171 |
| 4,654,989 | A | * | 4/1987 | Fleming | G09F 7/02 40/427 |
| 4,942,965 | A | * | 7/1990 | Comer | B65D 71/70 206/419 |
| 5,024,328 | A | | 6/1991 | Bontrager | |
| 5,160,473 | A | | 11/1992 | Bontrager | |
| 5,168,996 | A | * | 12/1992 | Johnson | B65D 5/5028 206/460 |
| 5,542,535 | A | * | 8/1996 | Dalton | B65D 85/42 182/129 |

(Continued)

FOREIGN PATENT DOCUMENTS

| | | | | | |
|---|---|---|---|---|---|
| DE | 4243295 | A1 | * | 6/1994 | B65D 81/05 |

*Primary Examiner* — Stephen F. Gerrity
*Assistant Examiner* — Daniel Jeremy Leeds
(74) *Attorney, Agent, or Firm* — F. Chau & Associates, LLC

(57) ABSTRACT

A package insert for cushioning an object during transport includes a plurality of support pins disposed in parallel with respect to each other, and a perforated sheet having a plurality of perforation holes disposed therein. Each of the plurality of supporting pins is disposed within a corresponding perforation hole of the plurality of perforation holes. Each of the plurality of perforation holes has a diameter or width that is equal to or smaller than a diameter or width of its corresponding supporting pin such that the corresponding supporting pin is kept in place by friction when inserted into the corresponding perforation hole.

10 Claims, 11 Drawing Sheets

(56) References Cited

U.S. PATENT DOCUMENTS 5,796,620 A * 8/1998 Laskowski ..... B29C 33/302 700/118
6,026,527 A * 2/2000 Pearce ..... A43B 13/04 428/137
6,128,889 A * 10/2000 Fuss ..... B65B 9/15 53/472
6,189,246 B1 * 2/2001 Gorthala ..... G09F 7/06 40/427
6,633,416 B1 * 10/2003 Benson ..... G06F 3/002 358/471
6,903,871 B2 * 6/2005 Page ..... B29C 33/307 359/277
7,587,884 B2 * 9/2009 Durand ..... B65B 5/024 53/376.4
7,647,752 B2 * 1/2010 Magnell ..... B65B 5/02 493/52
8,333,279 B2 * 12/2012 Veiseh ..... B65B 5/067 206/524.8
8,376,136 B2 * 2/2013 Arai ..... B65D 5/5057 206/419
8,434,748 B1 * 5/2013 Pearce ..... B68G 5/00 267/142
8,756,901 B2 * 6/2014 Carey ..... B65B 55/20 53/415
9,142,105 B1 * 9/2015 Crofford ..... G06F 3/016
9,248,611 B2 * 2/2016 Divine ..... B33Y 50/02
9,273,471 B2 * 3/2016 Fischer ..... E04F 15/02172
9,298,264 B2 * 3/2016 Leithinger ..... G06F 3/017
9,298,706 B2 * 3/2016 Magnell ..... G06F 17/30
9,371,147 B2 * 6/2016 Straver ..... B65B 55/20
9,434,496 B2 * 9/2016 Sytema ..... B65D 5/6664
9,688,452 B1 * 6/2017 Ross ..... B65D 81/052
9,821,925 B2 * 11/2017 Yamazaki ..... B65B 5/02
2006/0278554 A1 * 12/2006 Tanaka ..... B65B 55/20 206/522
2008/0251408 A1 * 10/2008 Kasboske ..... B65D 81/052 206/522
2010/0005594 A1 * 1/2010 Rancourt ..... A47C 23/002 5/652
2013/0126383 A1 * 5/2013 Bradford ..... B65D 19/44 206/521
2013/0284633 A1 * 10/2013 Viebahn ..... B65D 81/1075 206/523
2014/0190976 A1 * 7/2014 Imbrecht ..... B65D 19/18 220/592.01
2014/0272412 A1 * 9/2014 Singh ..... B65D 81/09 428/398
2015/0367974 A1 * 12/2015 Sytema ..... B65B 43/14 53/461
2016/0176606 A1 * 6/2016 Redondo Garcia .. B65D 81/052 206/521
2016/0194134 A1 * 7/2016 Chang ..... B65D 81/022 206/521
2017/0113862 A1 * 4/2017 Malone ..... B65B 5/04

* cited by examiner

METHOD FOR USING A PACKAGE INSERT FOR CUSHIONING AN OBJECT

BACKGROUND

The present invention relates to cushioning an object during transport, and more specifically, to a package insert for cushioning an object during transport and a method for using the package insert.

Irregularly shaped and delicate items may be difficult to transport securely. Generally, when shipping an item, the item must be packed into a box. Internal padding may be inserted in the box to protect the item from shocks experienced in transit. Air-filled cushions or foam chips may allow an item to shift during transit so that the item may rest against the inside of the box. This can lead to the item being damaged from a shock inflicted on the wall of the container on which the item is resting. Custom-made foam inserts require expensive design and tooling processes that are impractical for packaging a small number of similarly-shaped and/or sized items. Foam-in-bag custom packaging also requires expensive equipment and supplies to use. Other custom packaging methods rely on the skill of the user to securely package the item, and are time consuming.

SUMMARY

According to an exemplary embodiment of the present invention, a package insert for cushioning an object during transport includes a plurality of support pins disposed in parallel with respect to each other, and a perforated sheet having a plurality of perforation holes disposed therein. Each of the plurality of supporting pins is disposed within a corresponding perforation hole of the plurality of perforation holes. Each of the plurality of perforation holes has a diameter or width that is equal to or smaller than a diameter or width of its corresponding supporting pin such that the corresponding supporting pin is kept in place by friction when inserted into the corresponding perforation hole. In the case of pins whose cross-sectional shape may be tiled (e.g., regular hexagons) such that sufficient contact is made between the pins to provide enough friction to hold the pins in place during fitting then the perforation hole may be singular so that the massed pins fill this hole rather than each pin filling an individual hole. In an arrangement, a mass of pins maybe contained within an outer frame (e.g., made of cardboard). The pins may be free to slide independently of each other, and might not be coupled to each other.

According to an exemplary embodiment of the present invention, a package insert for cushioning an object during transport includes a container. A first plurality of support pins is disposed in parallel with respect to each other within the container. A first perforated sheet, having a first plurality of perforation holes disposed therein, is disposed within the container. A second plurality of support pins is disposed in parallel with respect to each other within the container. A second perforated sheet having a second plurality of perforation holes disposed therein, is disposed within the container. Each of the first plurality of supporting pins is disposed within a corresponding perforation hole of the first plurality of perforation holes. Each of the second plurality of supporting pins is disposed within a corresponding perforation hole of the second plurality of perforation holes. Each of the first and second pluralities of perforation holes has a diameter or width that is equal to or smaller than a diameter or width of its corresponding supporting pin such that the corresponding supporting pin is kept in place by friction when inserted into the corresponding perforation hole. Each of the first and second pluralities of supporting pins have a height that is greater than or equal to one half of the height of the container.

According to an exemplary embodiment of the present invention, a method for packaging an object includes setting the object on a surface. A first package insert is pressed over the object. The first package insert includes a first plurality of support pins disposed in parallel with respect to each other, and a first perforated sheet, having a first plurality of perforation holes disposed therein, wherein each of the first plurality of supporting pins is disposed within a corresponding perforation hole of the first plurality of perforation holes. The first package insert is pressed such that the arrangement of the first plurality of support pins, relative to the first perforated sheet, aligns to contour with the object. The protruding pins are then trimmed so that the first package insert may be replaced in its container preserving the impression of the object. (step S2 in FIG. 13). The first package insert is placed upside-down within a container. The object is placed upside-down, within the container on top of the first package insert. A second package insert is pressed within the container such that the object is disposed within the container between the first and second package insert. The second package insert includes a second plurality of support pins disposed in parallel with respect to each other, and a second perforated sheet having a second plurality of perforation holes disposed therein. The second package insert is pressed such that the arrangement of the second plurality of support pins, relative to the second perforated sheet, aligns to contour with the object. The second plurality of support pins are trimmed such that each of the second plurality of support pins extends to the top of the container.

BRIEF DESCRIPTION OF THE DRAWINGS

The above and other features and aspects of the present invention will become more apparent by describing in detail exemplary embodiments thereof with reference to the accompanying drawings, in which.

DETAILED DESCRIPTION

Figure 1:
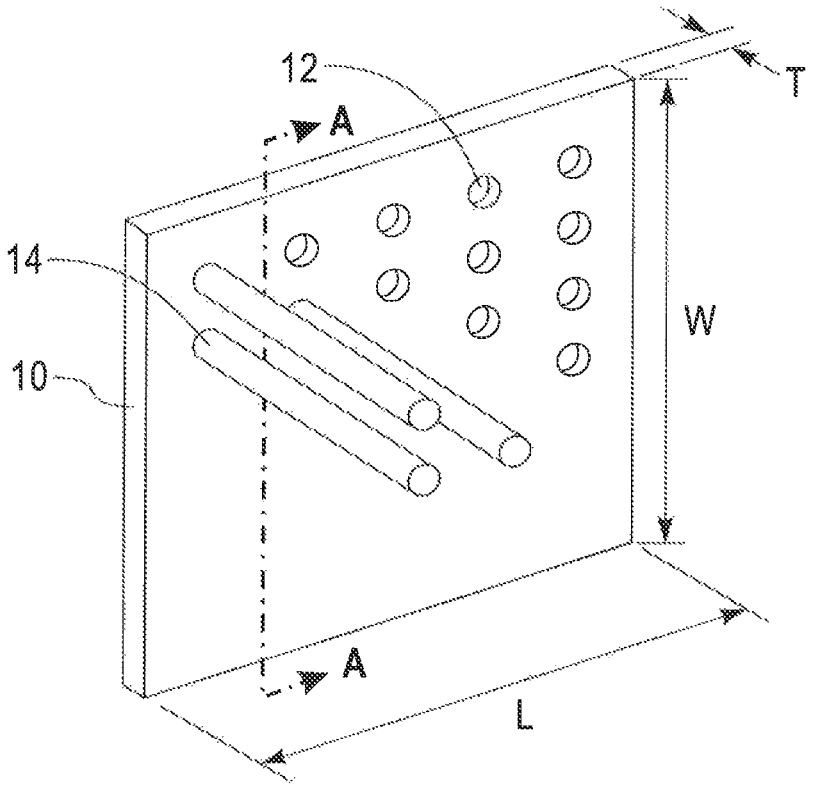
FIG. 1 is a perspective view of a package insert, according to an exemplary embodiment of the present invention.

The descriptions of the various exemplary embodiments of the present invention have been presented for purposes of illustration, but are not intended to be exhaustive or limited to the exemplary embodiments disclosed. Many modifications and variations will be apparent to those of ordinary skill in the art without departing from the scope and spirit of the described exemplary embodiments. The terminology used herein was chosen to best explain the principles of the exemplary embodiments, or to enable others of ordinary skill in the art to understand exemplary embodiments described herein.

The elements illustrated in the drawings might not be drawn to scale.

In accordance with an exemplary embodiment of the present invention, a package insert can be used to rapidly and cost-effectively package objects of various (e.g., irregular) shapes. The package inserts protect the object during shipping principally by effectively distributing the weight of the object evenly over a relatively wide area.

A package insert may include a perforated sheet and pins inserted in the perforated sheet. The pins may be parallel to each other and each pin may slide with respect to the perforation in which it is inserted. However, the pins do not slide on the perforations from their own weight due to the friction between each pin and the perforation in which the pin is inserted.

The perforated sheet and the pins may be made of recyclable material, for example, recyclable paper, cardboard, plastics, and the like. The pins may be flexible. However, flexibility of the pins is not necessary as the pins may be rigid.

When all the pins are fully extended on the same side of the perforated sheet, the perforated sheet, with the pins facing an object to be shipped, is be pressed against the object. When the perforated sheet is pressed against the object, the fully extended pins will be moved back with respect to the perforated sheet, according to the shape of the object. The moved-back pins surround a first side of the object. The same procedure, (e.g., pressing another perforated sheet with pins fully extended) may be performed on a second side, opposite to the first side, of the object using another perforated sheet with pins fully extended. Thus, when the object is disposed between the two perforated sheets, the object may be surrounded on all sides by the pins of the two perforated sheets.

When the pins are moved back (e.g., when pressing the pins against the object), the pins protrude from the rear side of the perforated sheet (e.g., the side of the perforated sheet that is opposite to the side of the perforated sheet that faces the object). The protruding pins can be cut at or near the rear side of the perforated sheet. For example, each pin may be cut at a same predetermined distance from the perforated sheet. This procedure can be performed on both perforated sheets. Thus, the rear side of each perforated sheet may be made flat, e.g., planarized.

The two perforated sheets, including the object disposed therebetween, may be inserted into a box. The box may have substantially the same dimensions or slightly larger dimensions, (e.g., length and width) as the two sheets, and the box may have substantially the same dimension or a slightly larger dimension, (e.g., depth) as the farthest distance between the pins of the two sheets. The box may then be sealed.

As a result of the custom-made support using the perforated sheets and the pins, the object may be protected during shipping. In addition, movement of the object inside of the box may be prevented by the pins. Thus, since the object will not move to rest against a side of the box, external impact to the box will be well dissipated over a large area of the object, and will not be directly transmitted to the object from the side of the box. The effect of external impact on the object may be reduced by the pins.

Figure 2:
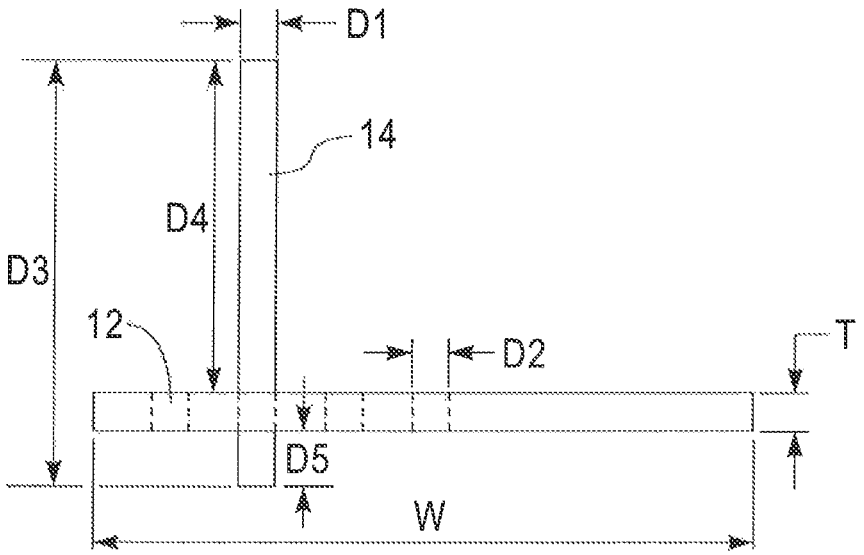
FIG. 2 is a cross-sectional view taken along line A-A of FIG. 1, according to an exemplary embodiment of the present invention.

FIG. 1 is a perspective view of a package insert, according to an exemplary embodiment of the present invention. FIG. 2 is a cross-sectional view taken along line A-A of FIG. 1, according to an exemplary embodiment of the present invention.

Referring to FIG. 1, a package insert includes a perforated sheet 10 and a plurality of pins 14. The perforated sheet 10 includes a plurality of perforations 12. Each of the plurality of pins 14 may be inserted into a corresponding perforation 12. The plurality of pins 14 may be parallel or substantially parallel to each other when inserted in their corresponding perforations 12. The perforated sheet 10 may have a length L, a width W, and a thickness T. It is understood that the number and arrangement of the perforations 12 illustrated in FIG. 1 are merely exemplary. The perforations 12 may be disposed throughout an entire surface area of the perforated sheet 10, the surface area being related to the length L and width W. The dimension of the length L, width W, and thickness T of the perforated sheet 10 may vary depending on the size, shape, weight, and other physical attributes of an object to be supported by the package insert.

For example, to package a terracotta flower pot that has a 12 inch top diameter, an 8 inch bottom diameter, and a 12 inch depth, two perforated sheets 10 may be used. Each perforated sheet 10 may have, for example, a length L of 18 inches, a width W of 18 inches, and a thickness T of ¼ inch. The pins 14 may have a D3 dimension of, for example, 9 inches. In addition, the pins 14 may have a ½ inch diameter.

Thus, when the flower pot is disposed between the two perforated sheets 10, the flower pot may be surrounded on all sides by the pins 14 and cushioned by the pins 14.

As shown in FIG. 1, the perforations 12 are circular, and the pins 14, inserted in the corresponding perforations 12, are cylindrical. Referring to FIG. 2, the diameter D2 of the circular perforations 12 is equal to or smaller than the diameter D1 of the pins 14. This way, each pin 14, inserted in a perforation 12, will not slide on the perforation 12 due to the weight of the pin 14 (e.g., from the effect of gravity) as a result of the frictional forces between the pin 14 and the perforated sheet 10. However, each pin 14 may be slid on a perforation 12 when an external force, larger than the frictional force between the pin 14 and its respective perforation 12, is applied to the pin 14. It is contemplated that where D1 is greater than D2, the pin 14 may be somewhat flexible or may have some give so that the pin 14 may still be squeezed into the perforation 12.

In the case of pins 14 whose cross-sectional shape may be tiled (e.g., regular hexagons) such that sufficient contact is made between the pins 14 to provide enough friction to hold the pins 14 in place during fitting, then the perforation 12 may be singular so that the massed pins 14 fill this perforation 12 rather than each pin 14 filling an individual perforation 12. In another approach, a mass of pins 14 maybe contained within an outer frame (e.g., made of cardboard or other material).

Figure 3:
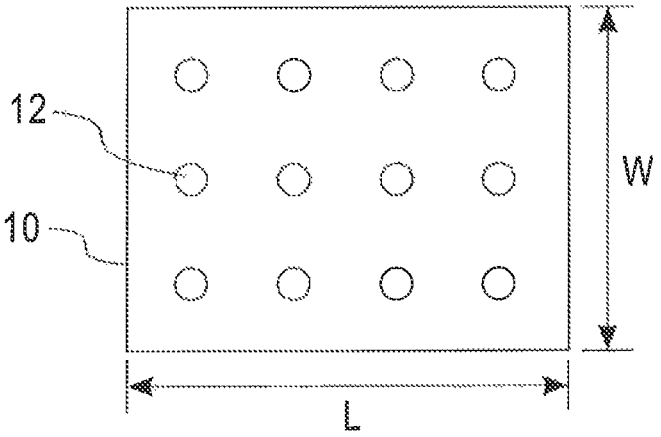
FIG. 3 is a plan view of a perforated sheet, according to an exemplary embodiment of the present invention.
Figure 4:
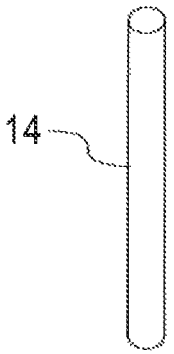
FIG. 4 is a perspective view of a pin that can be inserted into a perforation of the perforated sheet of FIG. 3, according to an exemplary embodiment of the present invention.

FIG. 3 is a plan view of a perforated sheet, according to an exemplary embodiment of the present invention. FIG. 4 is a perspective view of a pin that can be inserted into a perforation of the perforated sheet of FIG. 3, according to an exemplary embodiment of the present invention.

Referring to FIG. 3, the perforated sheet 10 includes perforations 12 that are arranged in rows and columns on the surface of the perforated sheet 10. Since the perforations 12 of FIG. 3 are circular, the pins 14 that may be used with the perforated sheet 10 of FIG. 3 are cylindrical, as shown in FIG. 4.

Figure 5:
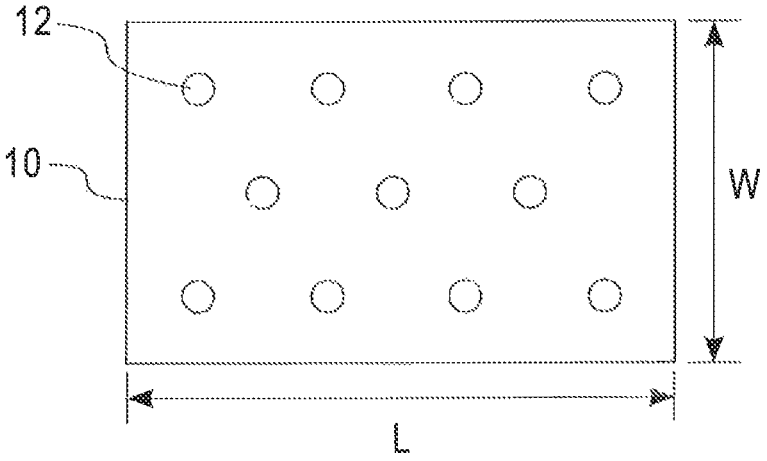
FIG. 5 is a plan view of a perforated sheet, according to an exemplary embodiment of the present invention.

FIG. 5 is a plan view of a perforated sheet, according to an exemplary embodiment of the present invention. As shown in FIG. 5, the perforations 12 may be staggered.

Figure 6:
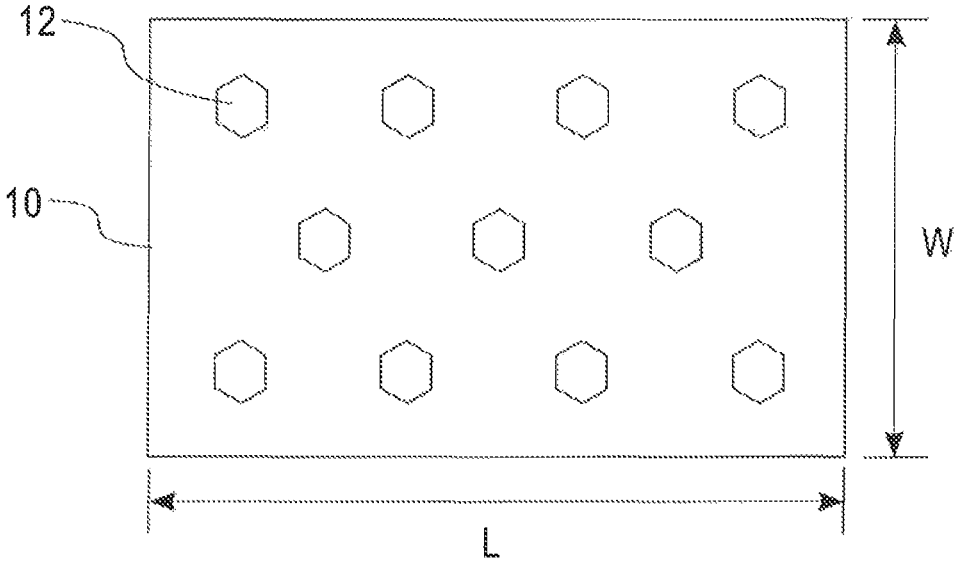
FIG. 6 is a plan view of a perforated sheet, according to an exemplary embodiment of the present invention.
Figure 7:
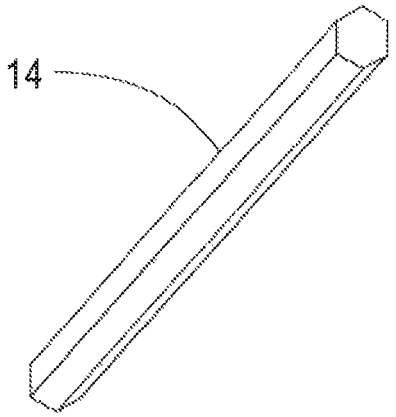
FIG. 7 is a perspective view of a pin that can be inserted into a perforation of the perforated sheet of FIG. 6, according to an exemplary embodiment of the present invention.

FIG. 6 is a plan view of a perforated sheet, according to an exemplary embodiment of the present invention. FIG. 7 is a perspective view of a pin that can be inserted into a perforation of the perforated sheet of FIG. 6, according to an exemplary embodiment of the present invention.

Referring to FIGS. 6 and 7, the perforations 12 are hexagonal, and the pins 14, to be inserted in the perforations 12, are hexagonal prisms. In this case, the perimeter of a perforation 12 is equal to or smaller than the outer perimeter of a pin 14. This way, the pins 14 do not slide with respect to the perforated sheet 10 when acted upon only by gravity as a result of the friction between the pins 14 and their respective perforation 12. However, as described above, the pins 14 may slide on the perforation 12 when an external force is applied to the pins 14. In this case, the external force is greater than the frictional force between the pins 14 and their respective perforations 12.

Figure 8:
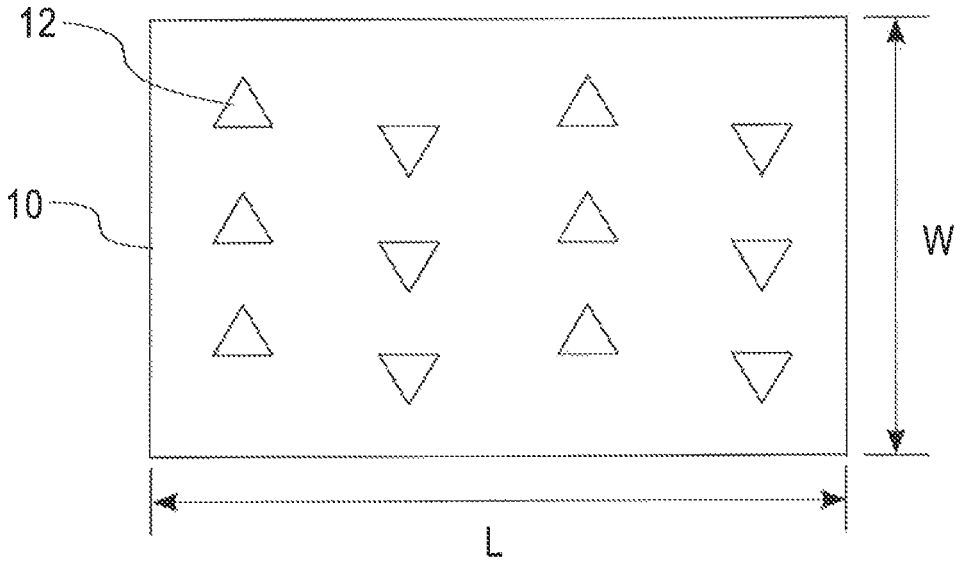
FIG. 8 is a plan view of a perforated sheet, according to an exemplary embodiment of the present invention.
Figure 9:
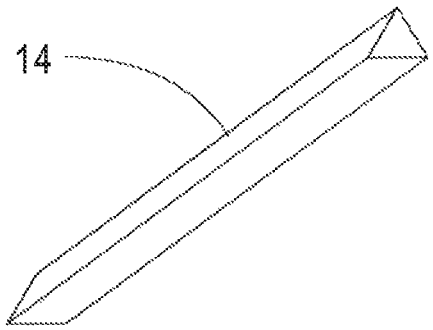
FIG. 9 is a perspective view of a pin that can be inserted into a perforation of the perforated sheet of FIG. 8, according to an exemplary embodiment of the present invention.

FIG. 8 is a plan view of a perforated sheet, according to an exemplary embodiment of the present invention. FIG. 9 is a perspective view of a pin that can be inserted into a perforation of the perforated sheet of FIG. 8, according to an exemplary embodiment of the present invention.

Referring to FIGS. 8 and 9, the perforations 12 are triangular and the pins 14, to be inserted in the perforations 12, are triangular prisms. In addition, the perforations 12 are disposed such that the perforations 12 of the same column are aligned in a direction opposite to that of the perforations 12 of the adjacent column, although this alignment is provided only as one possible embodiment.

Figure 10:
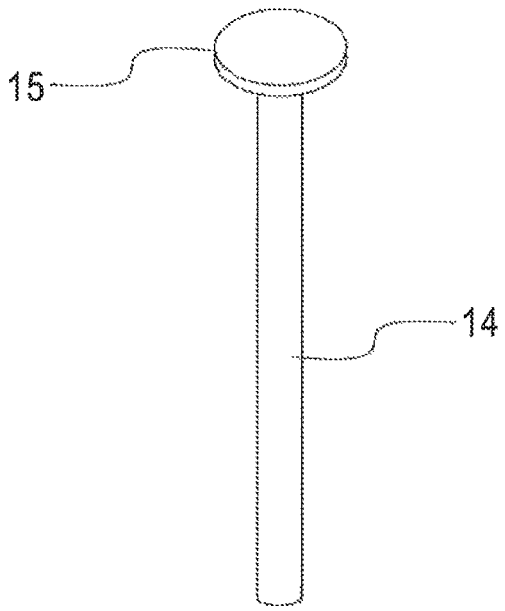
FIG. 10 is a perspective view of a pin, according to an exemplary embodiment of the present invention.

FIG. 10 is a perspective view of a pin, according to an exemplary embodiment of the present invention. The pin 14 of FIG. 10 includes a pin head 15. The pin head 15 may prevent the pin 14 from sliding out of the perforated sheet 10. The pin 14 may be of any shape and length D3 (the length D3 of a pin 14 is illustrated in FIG. 2). The pin 14 may include the pin head 15. The pin head 15 may be larger (e.g., larger in circumference or external perimeter, when the pin head 15 is not curved) than the pin 14 in which it is included. In addition, the pin head 15 of a pin 14 may be larger than the perforation 12 in which the pin 14 with the pin head 15 is inserted, such that the pin head 15 does not pass through the perforation 12.

It is understood that the size, shape and arrangement of the perforations 12 on the perforated sheet 10 can be varied depending on the shape, size, weight, and other physical attributes of an object to be supported by the package insert. For example, the perforations 12 may be arranged to be latticed on the perforated sheet 10. In addition, the perforated sheet 10 may be shaped as a honeycomb. However, each pin 14 needs to have a shape that may be inserted in its respective perforation 12. In addition, the pins 14 need to be frictionally engaged with their respective perforations 12 in order to not slide on the perforations 12 due to the effect of gravity (e.g., from their own weight). However, the pins 14 may slide on the perforation 12 when an external force is applied to the pins 14. In this case, the external force is greater than the frictional force preventing the pins 14 from sliding from their own weight.

Each pin 14 may be hollow or solid (e.g., have no cavity therein). In addition, solid and hollow pins 14 may be inserted in the same perforated sheet 10.

The perforated sheet 10 may be made of, for example, cardboard, corrugated paperboard, corrugated plastic (e.g., coroplast), or a polymer. The polymer may include, for example, polystyrene, polyurethane, polyethylene, polypropylene, poly(vinyl chloride), and polycarbonate. The polymer may also be foam. In addition, the perforated sheet 10 may include cell foams (e.g., closed-cell foam). The perforated sheet 10 may also be made of potato starch plastic, which may be bio-degradable. Further, the perforated sheet 10 may be recyclable.

The pins 14 may include, for example, cardboard, corrugated paperboard, corrugated plastic (e.g., coroplast), or a polymer. The polymer may include, for example, polystyrene, polyurethane, polyethylene, polypropylene, poly(vinyl chloride), and polycarbonate. The polymer may also be foam. In addition, the pins 14 may include cell foams (e.g., closed-cell foam). The pins 14 may also be made of potato starch plastic. In an exemplary embodiment of the present invention, the pins 14 may be similar in construction to drinking straws made of paper or plastic. The pins 14 may also be made of potato starch plastic, which may be bio-degradable. Further, the pins 14 may be recyclable.

The pins 14 may be semi-rigid (e.g., flexible). The pins 14 may be flexible to cushion an object supported by the pins 14. In an exemplary embodiment of the present invention, the perforated sheet 10 and the pins 14 are made of the same material.

According to an exemplary embodiment of the present invention, the pins 14 are cylinders having a diameter D1 of approximately one-half of an inch. The number of pins 14 per a given unit area of the perforated sheet 10 may vary depending on the weight, size and shape, and other physical attributes of the object to be supported by the pins 14. Thus, the number of the pins 14 included in a perforated sheet 10, and distances between the pins 14 depend on the weight, size, shape and other physical attributes of the object to be supported by the pins 14.

Referring to FIG. 2, each of the pins 14 may have the length D3. All of the pins 14 inserted in a perforated sheet 10 may have the same length D3. Alternatively, the pins 14 have different lengths D3. Each pin 14 may be slid (e.g., on its respective perforation 12) with respect to the perforated sheet 10 such that a length D4 of each pin 14 may be adjusted according to the shape of an object supported by the pins 14. A protrusion of each pin 14 protruding from a side of the perforated sheet 10, opposite to the side of the perforated sheet 10 facing the object supported by the pins 14, may have a length D5. The pins 14 may have different lengths D5, depending on the shape of the object.

Figure 11:
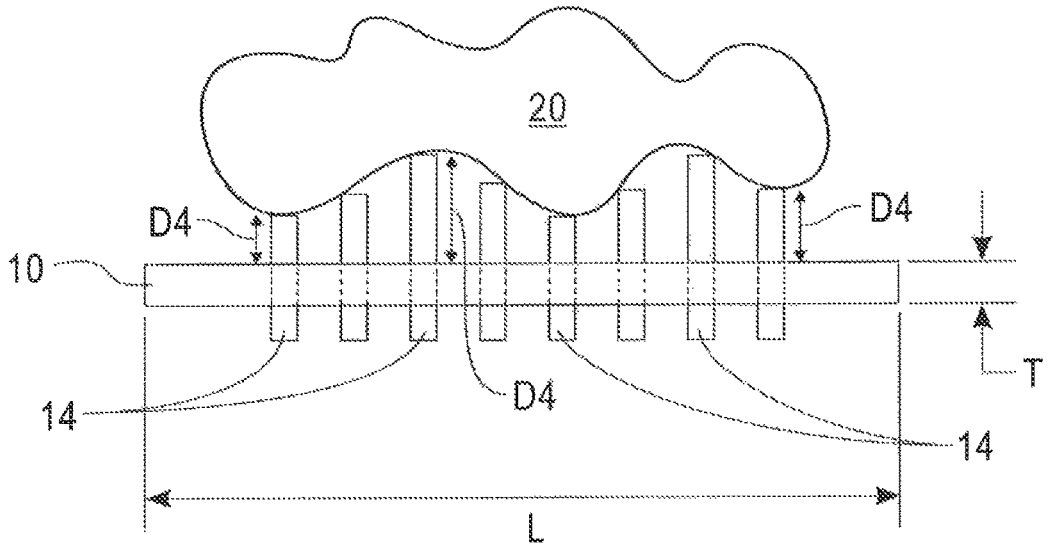
FIG. 11 is a top view of a package insert, according to an exemplary embodiment of the present invention.

FIG. 11 is a top view of a package insert, according to an exemplary embodiment of the present invention.

Referring to FIG. 11, an object 20 is supported by a package insert. The length D4 of each pin 14 varies depending on the shape of the surface of the object 20. As shown in FIG. 11, the object 20 is evenly supported by the pins 14 and perforated sheet 10. In this case, the length L of the perforated sheet 10 may be, for example, about 1.3 times greater than the length of the object 20. In addition, the thickness T of the perforated sheet 10 may be, for example, ¼ inch.

Figure 12:
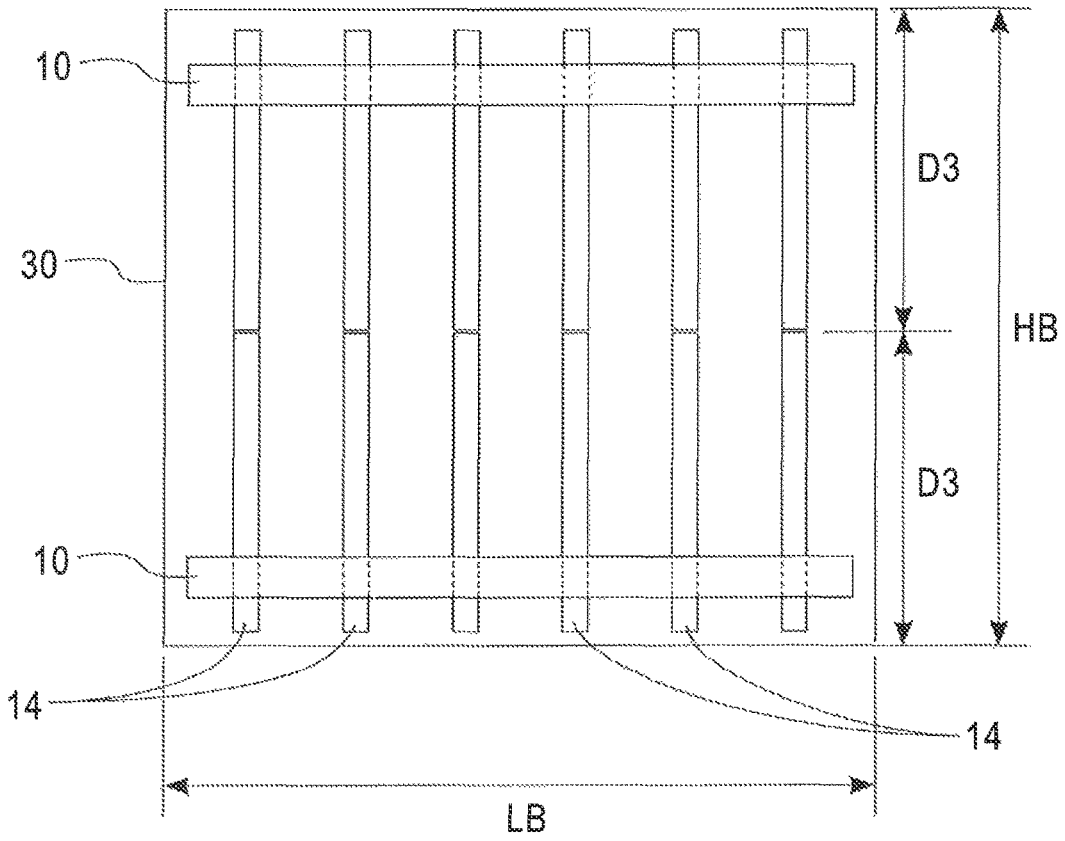
FIG. 12 is a side view of a package insert, according to an exemplary embodiment of the present invention.

FIG. 12 is a side view of a package insert, according to an exemplary embodiment of the present invention. Referring to FIG. 12, the package insert includes a container 30, a first perforated sheet 10, a second perforated sheet 10, a first set of pins 14 and a second set of pins 14.

The container 30 may be, for example, a box. The container 30 may have a length LB, a height HB, and a depth (the depth of the container 30 is not shown in FIG. 12). However, it is understood that the container 30 is a three-dimensional structure having walls and a given volume formed between the walls. In an exemplary embodiment of the present invention, the container 30 is a flat-folded box. In this case, the flat-folded box needs to be opened into its predetermined three-dimensional shape. In addition, when the container 30 is a flat-folded box, the container 30, the first perforated sheet 10, the second perforated sheet 10, the first set of pins 14 and the second set of pins 14 may be disposed outside of the container 30. The first and second perforated sheets 10 may also be flat-folded boxes.

The container 30 may be made of, for example, paper, cardboard, plastic, corrugated paper, corrugated cardboard, corrugated plastic, polymers (e.g., the same polymers listed above that can be included in the pins 14), potato starch plastic, wood, and the like. The container 30 may be made of recyclable material.

According to an exemplary embodiment of the present invention, the first perforated sheet 10, the second perforated sheet 10, the first set of pins 14 and the second set of pins 14 are disposed inside of the container 30, as shown in FIG. 12. In this case, the first set of pins 14 may be inserted in the perforations 12 of the first perforated sheet 10, and the second set of pins 14 may be inserted in the perforations 12 of the second perforated sheet 10. However, in an exemplary embodiment of the present invention, the first and second set of pins 14 might not be inserted in the perforations 12 of the first and second perforated sheets 10. When inserted in the perforations 12 of their respective first and second sheets 10, the pins 14 of the first set of pins 14 may be parallel to each other, and the pins 14 of the second set of pins 14 may be parallel to each other.

The length L of each first and second perforated sheet 10 may extend along the length LB of the container 30, and the first and second set of pins 14 may extend along the width height HB of the container 30. The first and second set of pins 14 may meet at a middle of the height HB of the container 30. In this case, the length D3 of each of the first and second set of pins 14 is equal to, or about, one-half of the height HB of the container 30. The width W of each of the first and second sheets 10 may be equal to the depth of the container 30 (the depth of the container 30 is not shown in FIG. 12). As stated above, the circumference/exterior perimeter of each of the first and second set of pins 14 may be equal to or smaller than the circumference/exterior perimeter of its corresponding opening 12.

The material included in the first and second set of pins 14 and the material included in the first and second sheets 10 may be the same as that described above. In addition, the shape and size of each of the first and second sheets 10, and the arrangement, size and shape of the perforations 12 in each of the first and second sheets 10 may be the same as those described above.

Figure 13:
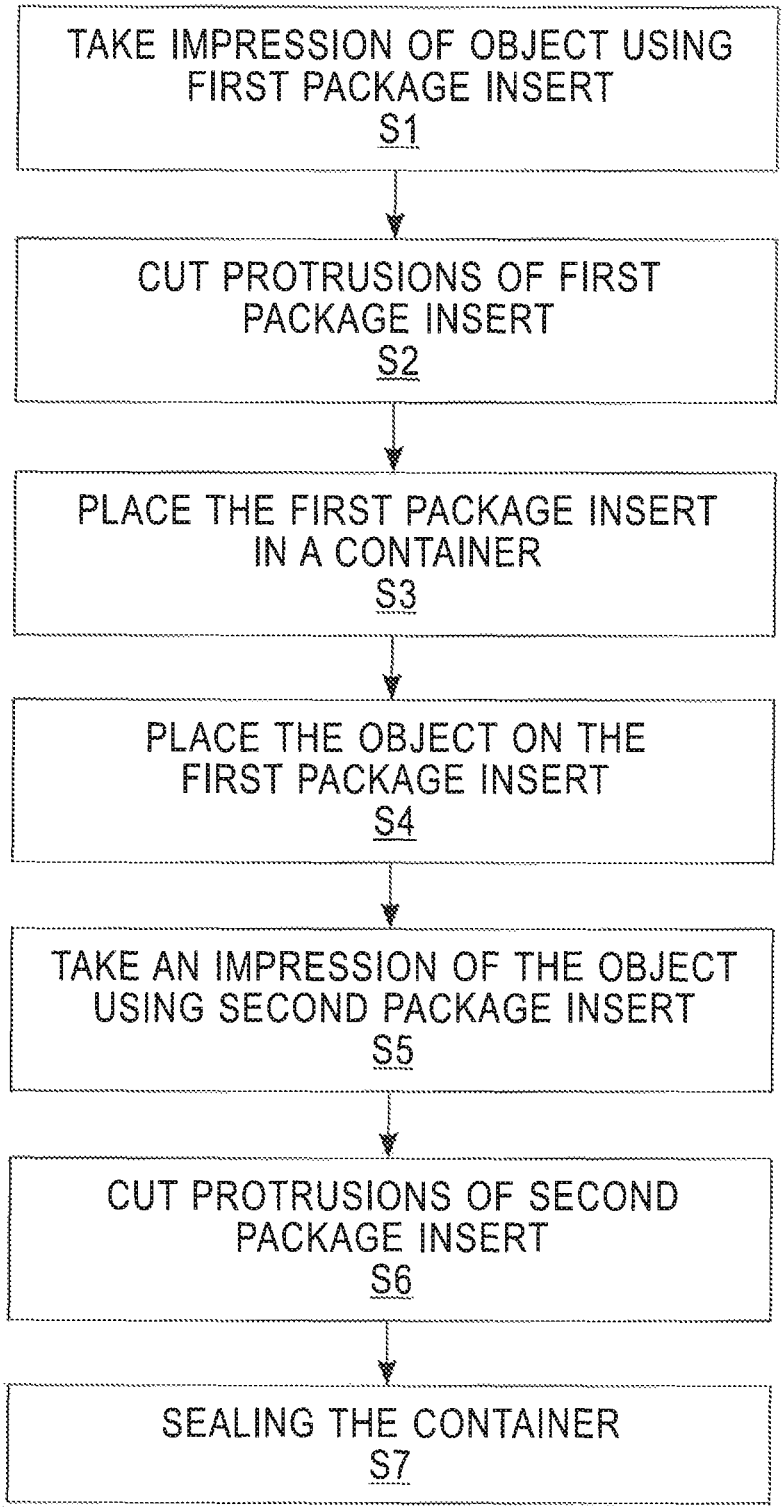
FIG. 13 is a flowchart illustrating a method for using a package insert, according to an exemplary embodiment of the present invention.

FIG. 13 is a flowchart illustrating a method for using a package insert, according to an exemplary embodiment of the present invention. The method of FIG. 13 may include using the container 30, the first and second sheets 10, and the first and second set of pins 14 of the package insert of FIG. 12. However, it is understood that package inserts having pins 14 with lengths D3 of equal to or greater than one-half of the width/height/depth of a container 30 may be used. In addition, the lengths D3 of the first and second set of pins 14 need not be equal to each other.

Figure 14:
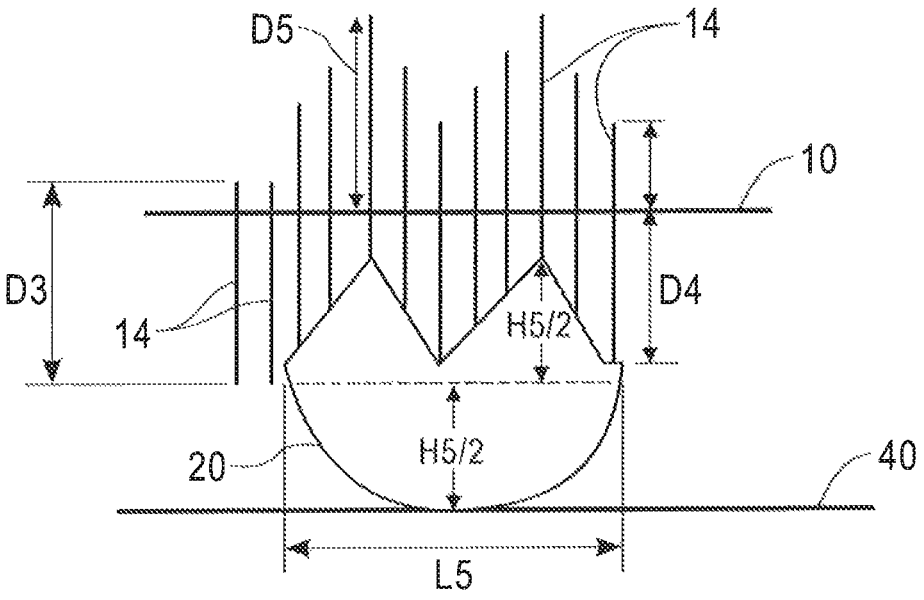
FIG. 14 is a side view illustrating the taking of an impression of an object using a first perforated sheet and a first set of pins, according to an exemplary embodiment of the present invention.

Referring to FIG. 13, step S1 includes taking an impression of an object 20 using the first perforated sheet 10 and the first set of pins 14. FIG. 14 is a side view illustrating the taking of an impression of the object 20 using the first perforated sheet 10 and the first set of pins 14, according to an exemplary embodiment of the present invention. It is understood that the object 20 is a three-dimensional object.

Step S1 may include opening the container 30 and retrieving the first perforated sheet 10 including the first set of pins 14 inserted therein. The first perforated sheet 10 and the first set of pins 14 may be referred to as a first package insert. Step S1 may also include disposing the object 20 on a surface 40. The object 20 may be, for example, irregularly shaped. Then, as illustrated in FIG. 14, step S1 (taking an impression of the object 20) includes taking the first package insert and pressing the first set of pins 14 of the first package insert on a first side (e.g., jagged side) of the object 20. In FIG. 14, the first perforated sheet 10 and the first set of pins 14 are represented by lines (e.g., the thickness of the first perforated sheet 10 and thicknesses the first set of pins 14 are not illustrated).

When pressing the first package insert on the first side of the object 20, the first set of pins 14 are moved with respect to the first perforated sheet 10 according to the shape of the first side of the object 20, as shown in FIG. 14. For example, the ends of the first set of pins 14 that face the object 20 correspond to points of a surface of the first side of the object 20.

The dimensions of the first and second package inserts may be such that the first and second set of pins 14 surround the object 20 on all sides of the object 20. In addition, the dimensions of the container 30 may be such that the first and second perforated sheets 10, including the object 20 and the first and second sets of pins 14 disposed therebetween, are snugly fit in the container 30. This means that the dimension D4 of the first and second set of pins 14 may be greater than zero (e.g., the object 20 does not rest directly on the first or second perforated sheet 10. However, according to an exemplary embodiment of the present invention, the object 20 may rest directly on the first or second perforated sheet 10, at least at one portion thereof. In this case, the dimension D4 of at least one of the first or second set of pins 14 may be zero.

In FIG. 14, it is shown that two of the first set of pins 14 extend beyond a left side of the object 20. In addition, to surround the right side of the object 20, one or more of the first set of pins 14 may extend beyond a right side of the object 20 to surround the right side of the object 20. No pins 14, from among the set of first pins 14, are illustrated on the right side of the object 20 of FIG. 14 for clarity.

It is understood that the number of pins 14 surrounding a side of the object 20 may vary depending on the weight, size, shape, and other physical characteristics of the object 20.

The object 20 may have a length L5, a height H5, and a depth (the depth of the object 20 is not shown in FIG. 14). FIG. 14 illustrates a dashed line at half of the height H5 dimension, or H5/2 of the object 20. The length D3 of each of the first set of pins 14 may be equal to, or greater than, the dimension H5/2. The first package insert may be pressed on the first side of the object 20 until the first set of pins 14 reach half of the height H5 (e.g., H5/2) of the object 20. The length L of the first perforated sheet 10 may be equal to, or greater than, the length L5 of the object 20. The width W of the first perforated sheet 10 may be equal to, or greater than, the depth of the object 20. According to an exemplary embodiment of the present invention, the length L of the first perforated sheet 10 is greater than the length L5 of the object 20, and the width W of the first perforated sheet 10 is greater than the depth of the object 20. The length L5 of the object 20 may be, for example, about two-thirds of the length L of the first perforated sheet 10. In addition, depth of the object 20 may be, for example, about two-thirds of the width W of the first perforated sheet 10. The smallest dimension D4 of the first set of pins 14 may be about one-sixth of the height H5.

Referring to FIG. 13, step S2 includes cutting the protrusions of the first package insert. The protrusions of the first package insert include the portion of the first set of pins 14 having the length D5 (e.g., the portion of each of the first set of pins 14 protruding from the side of the first perforated sheet 10 opposite to the side of the first perforated sheet 10 that faces the object 20.

The protrusions of the first package insert may be cut using, for example, a pair of scissors, a knife, a wire, and the like. After cutting the protrusions of the first package insert, the length D5 of the first set of pins 14 may be zero or close to zero.

When using the wire, a first end of the wire may be pinned to an edge of the first perforated sheet 10 (on the side of the first perforated sheet 10 on which the first set of pins protrude). A second end of the wire may be pulled to maintain tension in the wire. Then, the second end of the wire may be rotated on the first perforated sheet 10, while being disposed directly on, or close to, the first perforated sheet 10 to shear the protrusions of the first package insert. Alternatively, the both first and second ends of the wire may be pulled to maintain the wire in tension, and the wire may be moved across the first perforated sheet 10 in a variety of motions to shear the protrusions of the first package insert.

Figure 15:
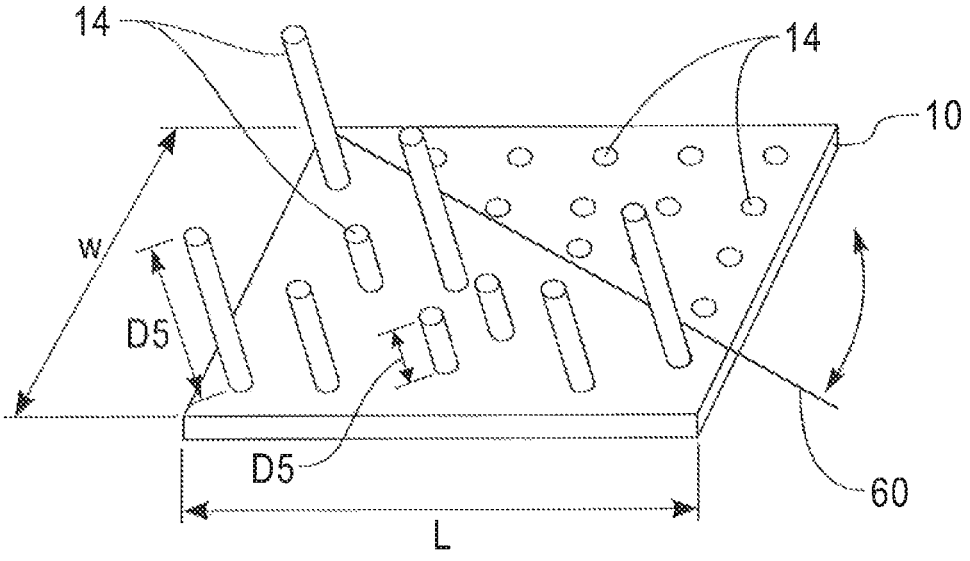
FIG. 15 is a perspective view illustrating the cutting of the protrusions of the first package insert, according to an exemplary embodiment of the present invention.

FIG. 15 is a perspective view illustrating the cutting of the protrusions of the first package insert, according to an exemplary embodiment of the present invention.

FIG. 15 illustrates the cutting of the protrusions of the first package insert using a wire 60. The wire 60 is pinned to a corner of the first perforated sheet 10 and is rotated in a clockwise direction. As it can be seen in FIG. 15, the rotation of the wire 60 in the clockwise direction shears the protrusions of the first package insert close to or exactly to a surface of the first perforated sheet 10. The wire 60 may be integrated on the perforated sheet 10 (e.g., the wire 60 may be pinned to the perforated sheet 10 by the manufacturer of the perforated sheet 10). However, the wire 10 may be supplied together with the perforated sheet 10 but not be pinned to the perforated sheet 10. In addition, a user may provide his/her own wire 60 to cut the pins 14.

Figure 16:
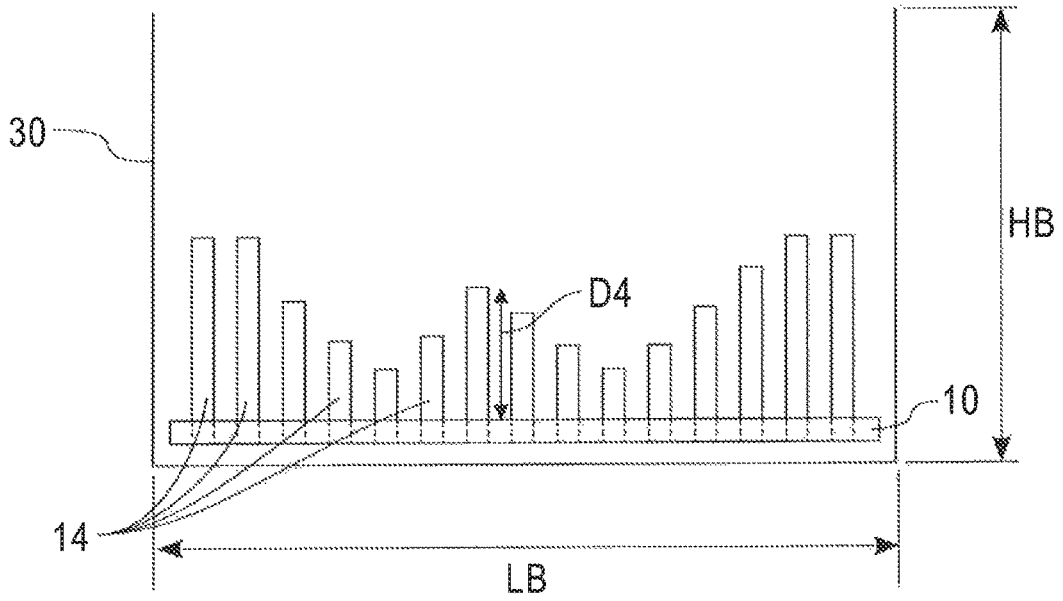
FIG. 16 is a side view illustrating the first package insert in a container, according to an exemplary embodiment of the present invention.

Referring to FIG. 13, step S3 includes placing the first package insert in the container 30. FIG. 16 is a side view illustrating the first package insert in the container 30, according to an exemplary embodiment of the present invention.

Referring to FIG. 16, the side of the package insert having the cut protrusions of the first set of pins 14 is disposed on and faces the inner (e.g., bottom) surface of the container 30. For example, the first package insert is disposed at the bottom of the container 30, and the first set of pins 14 extend up (e.g., vertically).

Figure 17:
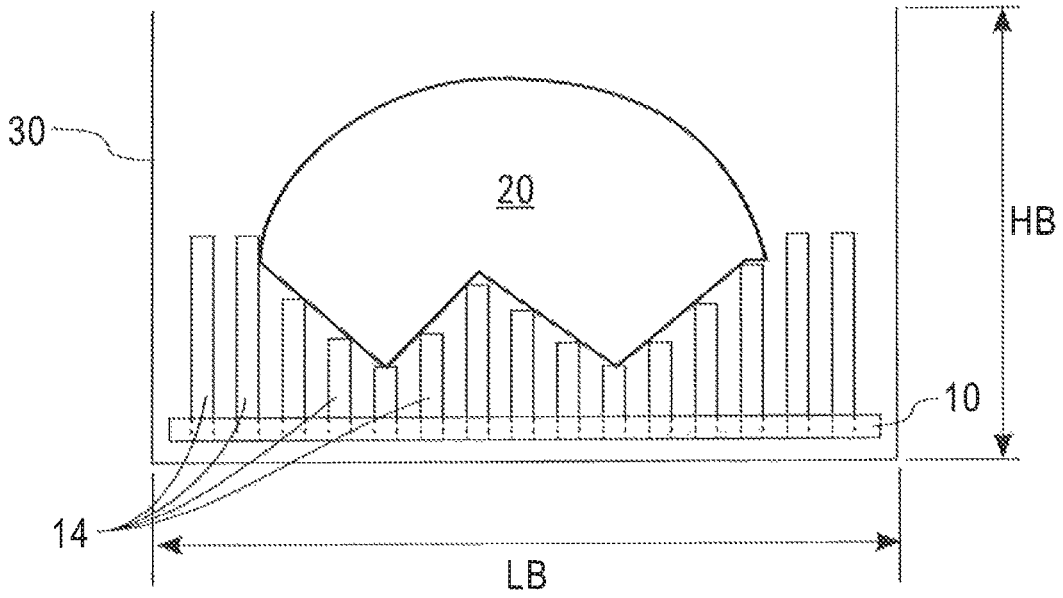
FIG. 17 is a side view of an object in the container, according to an exemplary embodiment of the present invention.

FIG. 17 is a side view of the object 20 in the container 30, according to an exemplary embodiment of the present invention.

Referring to FIGS. 17 and 13, step S4 includes disposing the object 20 on the first package insert inside the container 30. It is understood that the first (e.g., jagged) side of the object 20 which corresponds to the different lengths D4 of the first set of pins 14, is the side of the object 20 which is laid down on the first set of pins 14.

Figure 18:
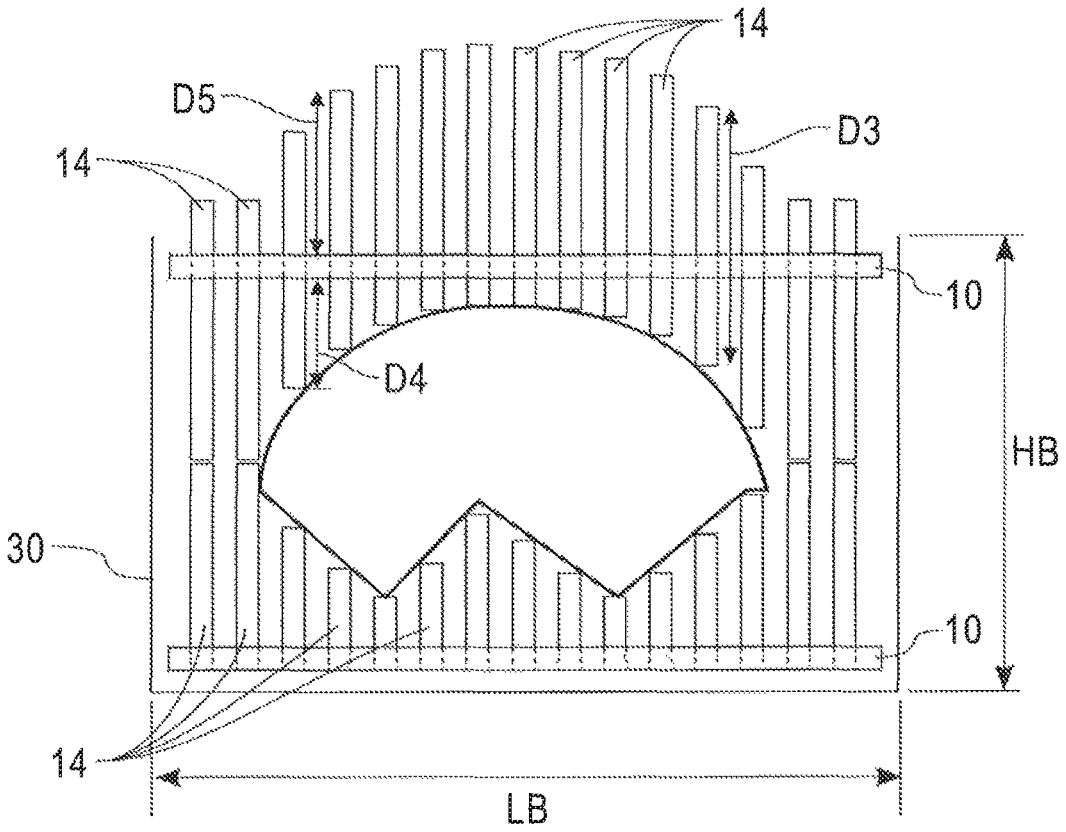
FIG. 18 is a side view illustrating the taking of an impression of the object using a second perforated sheet and a second set of pins, according to an exemplary embodiment of the present invention.

FIG. 18 is a side view illustrating the taking of an impression of the object 20 using the second perforated sheet 10 and the second set of pins 14, according to an exemplary embodiment of the present invention.

Referring to FIGS. 13 and 18, step S5 may includes taking the second package insert and pressing the second set of pins 14 of the second package insert on a second side (e.g., round side) of the object 20. The second side of the object 20 is opposite to the first side of the object 20.

When pressing the second package insert on the second side of the object 20, the second set of pins 14 are moved with respect to the second perforated sheet 10 according to the shape of the second side of the object 20, as shown in FIG. 18. For example, the ends of the second set of pins 14 that face the object 20 correspond to points of the second side of the object 20.

The length D3 of each of the second set of pins 14 may be equal to, or greater than, the dimension H5/2 of the object 20. The second package insert may be pressed on the second side of the object 20 until the second set of pins 14 reach half of the height H5 (e.g., H5/2) of the object 20. Thus, some of the first set of pins 14 and some of the second set of pins 14 may meet at about a middle (e.g., halfway) of the height H5 of the object 20. The length L of the second perforated sheet 10 may be equal to, or greater than, the length L5 of the object 20. The width W of the second perforated sheet 10 may be equal to, or greater than, the depth of the object 20. According to an exemplary embodiment of the present invention, the length L of the second perforated sheet 10 is greater than the length L5 of the object 20, and the width W of the second perforated sheet 10 is greater than the depth of the object 20. The length L5 of the object 20 may be, for example, about two-thirds of the length L of the second perforated sheet 10. In addition, depth of the object 20 may be, for example, about two-thirds of the width W of the second perforated sheet 10. The smallest dimension D4 of the second set of pins 14 may be about one-sixth of the height H5.

Referring to FIG. 13, Step S6 includes cutting the protrusions of the second package insert. The protrusions of the second package insert include the portion of the second set of pins 14 having the length D5 (e.g., the portion of each of the first set of pins 14 protruding from the side of the second perforated sheet 10 opposite to the side of the second perforated sheet 10 that faces the object 20. This may be performed as described above, for example, with reference to FIG. 15.

Figure 19:
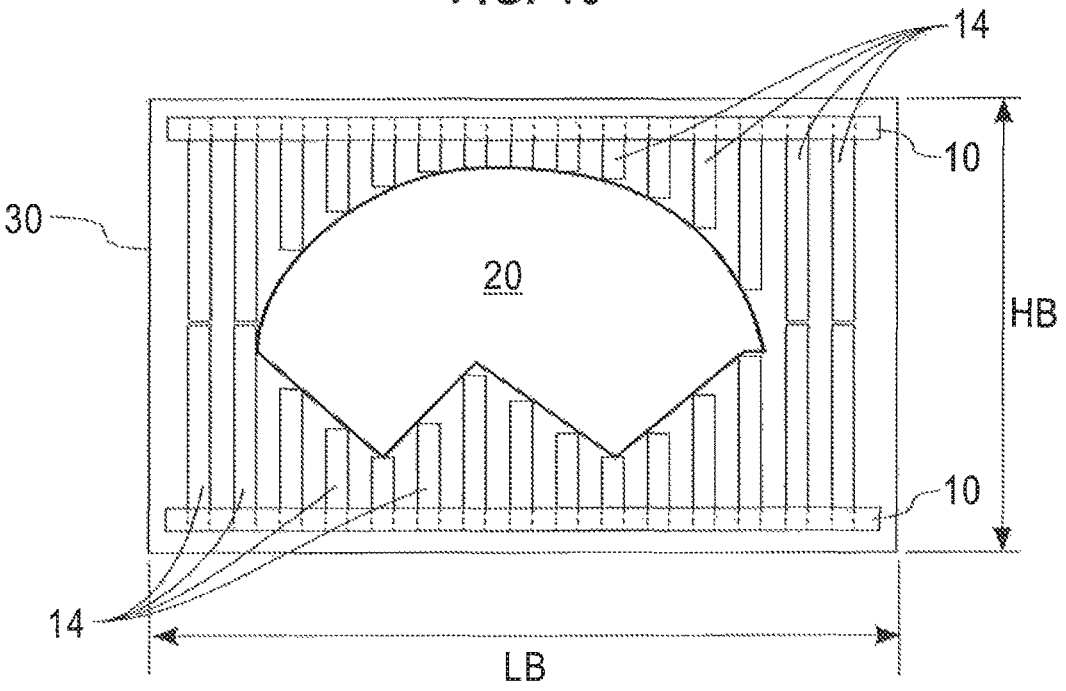
FIG. 19 illustrates the container including the first and second package inserts and the object, according to an exemplary embodiment of the present invention.

FIG. 19 illustrates the container 30 including the first and second package inserts and the object 20, according to an exemplary embodiment of the present invention.

As illustrated in FIG. 19, the protrusions of the second package insert have been cut. The protrusions of the second package insert may be cut to a length such that the tops of the second set of pins 14 extend to the top of the container 30. This may mean that the dimension D5 of the second set of pins 14 is greater than zero. Alternatively, the second perforated sheet 10 may be disposed such that the top of the second perforated sheet 10 is located at the top of the container 30.

Thus, the container 30 includes the object 20 supported by the first and second set of pins 14. The dimensions LB, HB and depth of the container 30 may be equal to, or slightly larger than the length L and width W of the first and second perforated sheets 10, and the distance between the first and second perforated sheets 10. Accordingly, the first and second package inserts, and the object 20 disposed therebetween, may be snugly fit in the container 30.

Referring to FIG. 13, step S7 includes sealing the container 30. Accordingly, the object 20 may be cushioned and protected by the first and second package inserts without wobbling or moving inside of the container 30 during transit. In addition, shocks inflicted on the container 30 may be absorbed by the first and second set of pins 14. Thus, the impact of the shocks inflicted on the container 30 may be greatly reduced on the object 20.

As shown in FIG. 19, the object 20 is surrounded by the first and second set of pins 14 all-around. Although the depth of the container 30 is not illustrated in FIG. 19, it is understood that the first and second set of pins 14 are disposed to surround the object 20 along the depth of the container 30.

According to an exemplary embodiment of the present invention, the first and second package inserts may be reused. For example, after being used to cushion a first object, the first and second set of pins 14 of the first and second package inserts may be reused to cushion a second object that is larger than or equal to the first object. When the second object is larger than the first object, the used pins 14 may be long enough to protrude from the back of the first and second package inserts 10 when taking the impression of the second object. The used pins 14 may protrude, for example, as illustrated in FIGS. 14 and 18. The protrusions may be cut. Thus, the same container and the first and second package inserts may be reused to ship the second object.

It is understood that the steps of the method of FIG. 13 need not be performed in the order shown in FIG. 13. The sequence of the performance of the steps S1 to S7 may be varied. For example, the second impression of the object 20 may be taken when the object 20 is disposed on the surface 40 (but flipped upside down so the second impression is that of the second side of the object 20). In addition, the trimming of the protrusions of the first and second set of pins 14 may be performed in any order.

Figure 20:
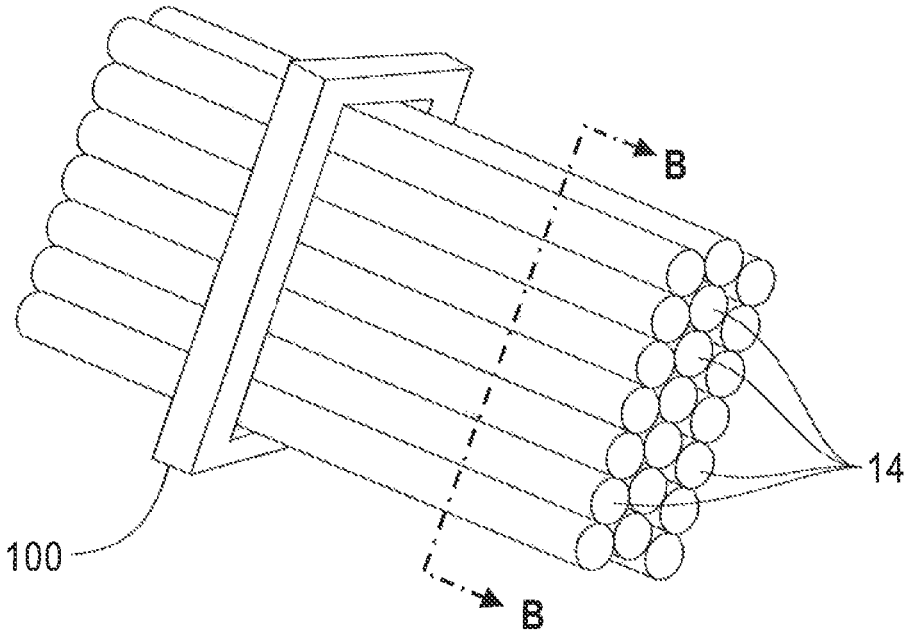
FIG. 20 is a perspective view of a package insert, according to an exemplary embodiment of the present invention.
Figure 21:
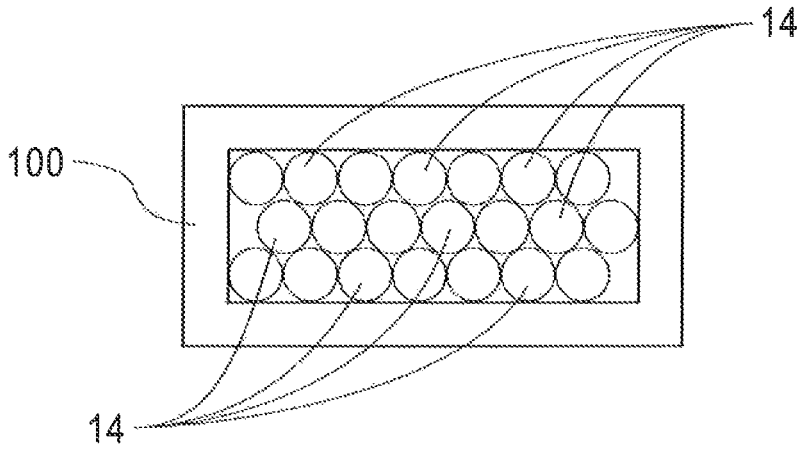
FIG. 21 is a cross-sectional view taken along line B-B of FIG. 20, according to an exemplary embodiment of the present invention.

FIG. 20 is a perspective view of a package insert, according to an exemplary embodiment of the present invention. FIG. 21 is a cross-sectional view taken along line B-B of FIG. 20, according to an exemplary embodiment of the present invention. Referring to FIGS. 20 and 21, a package insert includes a plurality of pins 14 and a frame 100. The frame 100 may include the same material as the container 30, or the pins 14, as described above. The pins 14 may be in direct contact with each other. The frame 100 may slightly compress the pins 14 to hold the pins 14 from sliding due to their own weight. For example, a number of pins 14, enough to fill an opening of the frame 100, may be inserted in the opening of the frame 100 such that the pins of are tightly-fit in the opening of the frame 100. The use of the frame 100 and the pins 14, according to the method of FIG. 13, will be apparent to those skilled in the art.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method for packaging an object, comprising:

setting the object on a surface;

pressing a first package insert over the object, the first package insert comprising: a first plurality of support pins disposed in parallel with respect to each other; and a first perforated sheet, having a first plurality of perforation holes disposed therein, wherein each of the first plurality of supporting pins is disposed within a corresponding perforation hole of the first plurality of perforation holes, wherein the first package insert is pressed such that the arrangement of the first plurality of support pins, relative to the first perforated sheet, aligns to contour with the object;

trimming portions of the first plurality of support pins that protrude from an opposing side of the first perforated sheet;

placing the first package insert, upside-down, within a container;

placing the object, upside-down, within the container on top of the first package insert;

pressing a second package insert within the container such that the object is disposed within the container between the first and second package insert, the second package insert comprising: a second plurality of support pins disposed in parallel with respect to each other; and a second perforated sheet having a second plurality of perforation holes disposed therein; wherein the second package insert is pressed such that the arrangement of the second plurality of support pins, relative to the second perforated sheet, aligns to contour with the object; and trimming the second plurality of support pins such that each of the second plurality of support pins extends to the top of the container.

2. The method of claim 1, wherein each of the first and second pluralities of support pins are cylindrical or prism-shaped.

3. The method of claim 1, wherein each of the first and second pluralities of perforation holes has a circular or polygon-shape.

4. The method of claim 1, wherein each of the first and second pluralities of supporting pins are disposed within their corresponding perforation holes such that the perforation holes are loose enough around the corresponding supporting pin so as to allow the supporting pin to be moved when an external force is applied but tight enough around the corresponding supporting pin so as to prevent the supporting pin from being moved under the force of gravity alone.

5. The method of claim 1, wherein each of the first and second pluralities of supporting pins is constructed of a polymer selected from the group consisting of polystyrene, polyurethane, polyethylene, polypropylene, poly(vinyl chloride), and polycarbonate.

6. The method of claim 1, wherein each of the first and second pluralities of supporting pins is constructed of a polymer foam.

7. The method of claim 1, wherein each of the first and second perforated sheet is constructed of corrugated paperboard, corrugated plastic, a polymer or a polymer foam.

8. The method of claim 1, further comprising sealing the container after the trimming of the second plurality of support pins.

9. The method of claim 1, wherein the second plurality of support pins are trimmed using a wire.

10. The method of claim 1, wherein;

an engagement of the first and second pluralities of supporting pins with their corresponding perforation holes provides a frictional force greater than the weight of the object; and the pressing of the first package insert and second package insert applies a pressure greater than the frictional force.

* * * * *